US009463946B2

(12) United States Patent
Herrmann

(10) Patent No.: US 9,463,946 B2
(45) Date of Patent: Oct. 11, 2016

(54) COLLATION SYSTEM WITH RETRACTING GUIDES

(71) Applicant: Xerox Corporation, Norwalk, CT (US)

(72) Inventor: Douglas K. Herrmann, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 107 days.

(21) Appl. No.: 14/594,711

(22) Filed: Jan. 12, 2015

(65) Prior Publication Data

US 2016/0200544 A1 Jul. 14, 2016

(51) Int. Cl.
*B65H 39/043* (2006.01)
*B65H 31/00* (2006.01)
*B65H 43/06* (2006.01)

(52) U.S. Cl.
CPC ..... *B65H 39/043* (2013.01); *B65H 31/00* (2013.01); *B65H 43/06* (2013.01); *B65H 2301/4211* (2013.01); *B65H 2301/42266* (2013.01)

(58) Field of Classification Search
CPC ..... B65H 39/03; B65H 31/00; B65H 43/06; B65H 2301/4211; B65H 2301/42266
USPC ..... 270/52.14, 52.16, 52.19, 52.01, 58.01, 270/58.23, 58.25, 58.26, 58.29
See application file for complete search history.

(56) References Cited

U.S. PATENT DOCUMENTS 2,479,060 A * 8/1949 Davidson ..... B65H 39/055 270/52.06
4,266,761 A * 5/1981 Buck ..... B42C 1/00 270/58.01
4,795,143 A * 1/1989 Tsai ..... B41F 17/007 101/50
5,273,265 A * 12/1993 Edwards ..... B65H 39/043 270/58.26
5,573,232 A * 11/1996 Ifkovits ..... B65H 39/02 270/51
5,685,531 A * 11/1997 Auerbach ..... B65H 39/02 270/51
5,810,346 A * 9/1998 Jorg ..... B65H 39/02 198/349.9
5,857,669 A * 1/1999 Ruggiero ..... B65H 39/06 270/45
8,262,074 B2 * 9/2012 Langenegger ..... B65H 31/26 270/52.14
8,342,505 B2 * 1/2013 Defigueiredo ..... B65H 29/12 270/52.21
8,371,568 B2 * 2/2013 Herrmann ..... B65H 29/242 270/52.14
2013/0064626 A1 * 3/2013 Buntemeyer ..... B65H 31/3018 412/1

OTHER PUBLICATIONS

U.S. Appl. No. 14/523,963, filed Oct. 27, 2014 and titled Taped Media Imposition for Adhesive In-Store Signage (copy attached)(unpublished).

(Continued)

*Primary Examiner* — Patrick Mackey
(74) *Attorney, Agent, or Firm* — Simpson & Simpson, PLLC

(57) ABSTRACT

A system for collating a plurality of media including a first bin, a second bin arranged adjacent to the first bin, a collated stack receiver arranged proximate the second bin opposite the first bin, first, second and third guides, the first and second guides positioned on opposing sides of the first bin, and the second and third guides positioned on opposing sides of the second bin, and a pusher. When the first, second and third guides are positioned in non-retracted locations, a first set of the plurality of media is deposited in the first bin and a second set of the plurality of media is deposited in the second bin. When the first, second and third guides are positioned in retracted locations, the pusher moves the first set to the second bin vertically above the second set to form a first combined set and moves the first combined set to the collated stack receiver.

22 Claims, 8 Drawing Sheets

(56) References Cited

OTHER PUBLICATIONS

U.S. Appl. No. 14/524,018, filed Oct. 27, 2014 and titled Variable Guide System for Shingling In-Store Adhesive Signage (copy attached)(unpublished).

U.S. Appl. No. 14/582,426, filed Dec. 24, 2014 and titled Multi-Stage Collation System and Method for High Speed Compiling of Sequentially Ordered Instore Signage (copy attached)(unpublished).

* cited by examiner

COLLATION SYSTEM WITH RETRACTING GUIDES

TECHNICAL FIELD

The presently disclosed embodiments are directed to providing a collation system, more particularly to a collation system having retracting guides, and even more particularly to a collation system having retracting guides positioned to ensure accurate media placement when arranged in non-retracted positions and to permit sequential stacking when in retracted positions.

BACKGROUND

Retail stores often utilize signage to convey information regarding products offered for sale, e.g., product cost, unit cost, sale pricing, etc. Such signage must be updated and/or replaced on a periodic basis. For example, regular product pricing may change, or during a sale, a discounted price may be necessary. Changes to signage may be required for hundreds or even thousands of products and these changes may be required daily, weekly or another periodic term. In some states, it is critical that the signage be updated in a timely fashion as the retail store may be obligated to honor the price displayed adjacent the product. In other words, if the store fails to remove signage that displays a discounted cost, the store must charge that cost if a customer relies upon that price when making a purchase selection. In view of the foregoing, it should be apparent that proper timing and placement of signage is a critical responsibility of a retail store.

Although some retail chain stores share common store layouts, also known as a store planogram, most retail locations, even within a chain store, have unique store planograms. The changeover of signage can incur significant time which in turn incurs significant cost. A common practice is to print sheets of signage and an employee or group of employees are tasked with signage changeover. These methods include various deficiencies, e.g., sheets printed out of order or not matched to the store planogram, sheets that require further separation of individual signage labels, etc.

In view of the foregoing issues, some stores require signage to be in a per store planogram order and to be pre-separated, both to facilitate the efficient changeover of signage. It has been found that to achieve this arrangement of signage, signage labels or cards are imposed so that each set of labels is in sequential order within a sheet and then across the collection of sheets. For example, cards may be delivered to various stores in stacks of ninety-six cards each stack thereby requiring three sheets, each sheet containing thirty-two labels, to be collated sequentially to produce a complete stack. Cards of this type may be cut using a high speed cutting system. The cards may be fed from a slitter system into bins, however it has been found that these systems are ineffective as the cards are not guided and adjacent cards interfere with each other as they bounce and settle into the bins. Such systems cause a high percentage of media jams and thus result is downtime and increased costs. Moreover, these systems are dependent on operator actions which are less predictable than an automated system. Examples of other signage production and signage cutting/collating systems are described in U.S. patent application Ser. No. 14/523,963, filed on Oct. 27, 2014 and titled TAPED MEDIA IMPOSITION FOR ADHESIVE IN-STORE SIGNAGE, U.S. patent application Ser. No. 14/524,018, filed on Oct. 27, 2014 and titled VARIABLE GUIDE SYSTEM FOR SHINGLING IN-STORE ADHESIVE SIGNAGE, and U.S. patent application Ser. No. 14/582,426, filed on Dec. 24, 2014 and titled MULTI-STAGE COLLATION SYSTEM AND METHOD FOR HIGH SPEED COMPILING OF SEQUENTIALLY ORDERED IN-STORE SIGNAGE.

The present disclosure addresses all these problems in a practical and cost effective method.

SUMMARY

Broadly, the apparatus and methods discussed infra provide a retractable guide system as part of a cross process collating system which ensures that each card remains in its assigned bin while allowing for movement of the guide system to allow a pusher to collate a plurality of sets. The guide system which includes a plurality of guides remains in place during a card compiling process and is pneumatically retracted prior to a cross process collation of the card sets. This retraction allows for a guide system that can be removed for cross process collation of the sets during compiling.

According to aspects illustrated herein, there is provided a system for collating a plurality of media including a first bin, a second bin arranged adjacent to the first bin, a collated stack receiver arranged proximate the second bin opposite the first bin, first, second and third guides, where the first and second guides are positioned on opposing sides of the first bin, and the second and third guides are positioned on opposing sides of the second bin, and a pusher. When the first, second and third guides are positioned in non-retracted locations, a first set of the plurality of media is deposited in the first bin and a second set of the plurality of media is deposited in the second bin, and when the first, second and third guides are positioned in retracted locations, the pusher moves the first set to the second bin vertically above the second set to form a first combined set and then moves the first combined set to the collated stack receiver.

According to other aspects illustrated herein, there is provided a method for collating a plurality of media in a system including a first bin, a second bin arranged adjacent to the first bin, a collated stack receiver arranged proximate the second bin opposite the first bin, first, second and third guides, where the first and second guides are positioned on opposing sides of the first bin, and the second and third guides are positioned on opposing sides of the second bin, and a pusher. The method includes: a) positioning the first, second and third guides in non-retracted locations; b) depositing a first set of the plurality of media in the first bin and a second set of the plurality of media in the second bin; c) positioning the first, second and third guides in retracted locations; d) moving the first set with the pusher to the second bin vertically above the second set to form a first combined set; and, e) moving the first combined set with the pusher to the collated stack receiver.

Other objects, features and advantages of one or more embodiments will be readily appreciable from the following detailed description and from the accompanying drawings and claims.

BRIEF DESCRIPTION OF THE DRAWINGS

Various embodiments are disclosed, by way of example only, with reference to the accompanying drawings in which corresponding reference symbols indicate corresponding parts, in which.

DETAILED DESCRIPTION

Figure 1:
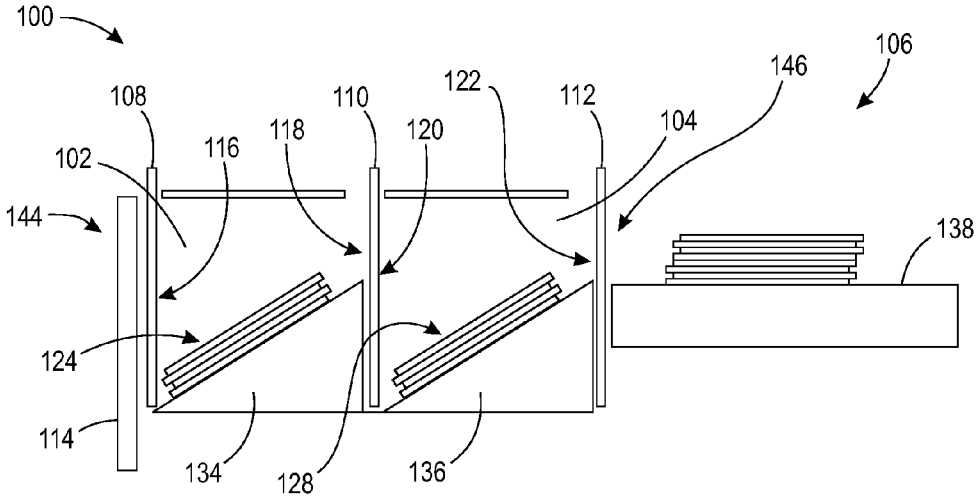
FIG. 1 is a side elevational view of an embodiment of a present system for collating media with a plurality of guides in non-retracted positions.
Figure 2:
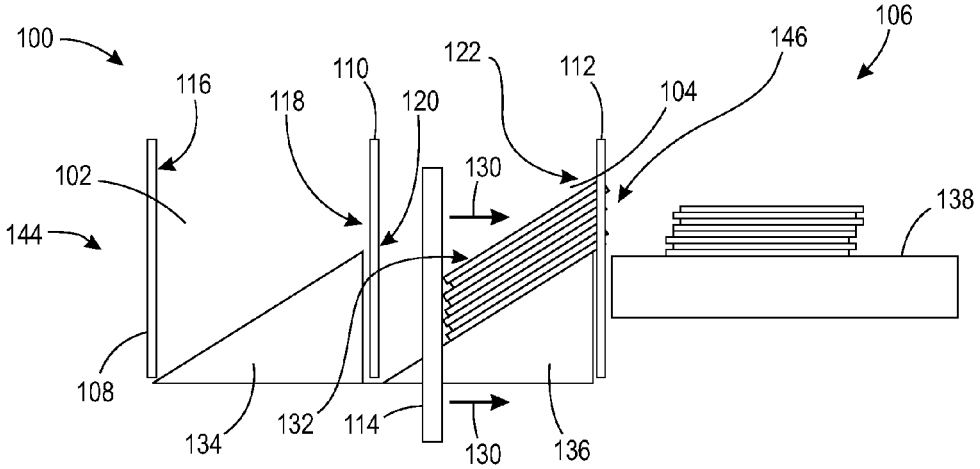
FIG. 2 is a side elevational view of the present system depicted in FIG. 1 with the plurality of guides in retracted positions and a pusher moving stacks of media toward a collated stack receiver.
Figure 3:
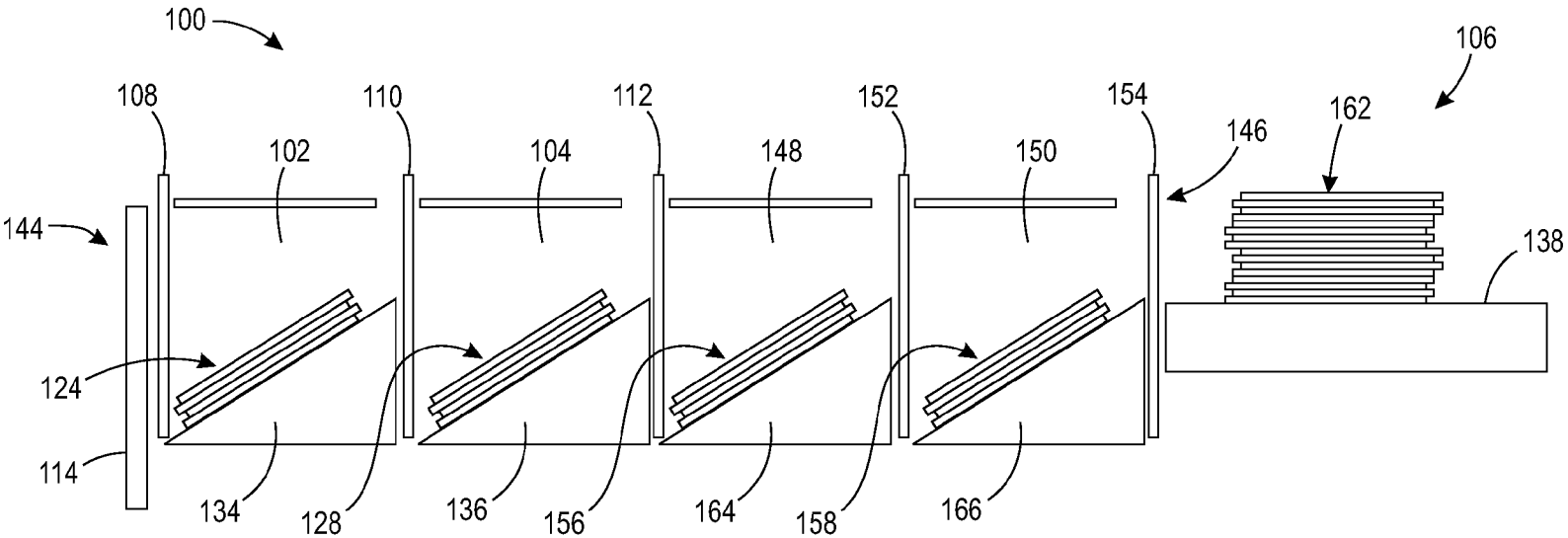
FIG. 3 is a side elevational view of another embodiment of a present system for collating media with a plurality of guides in non-retracted positions.
Figure 4:
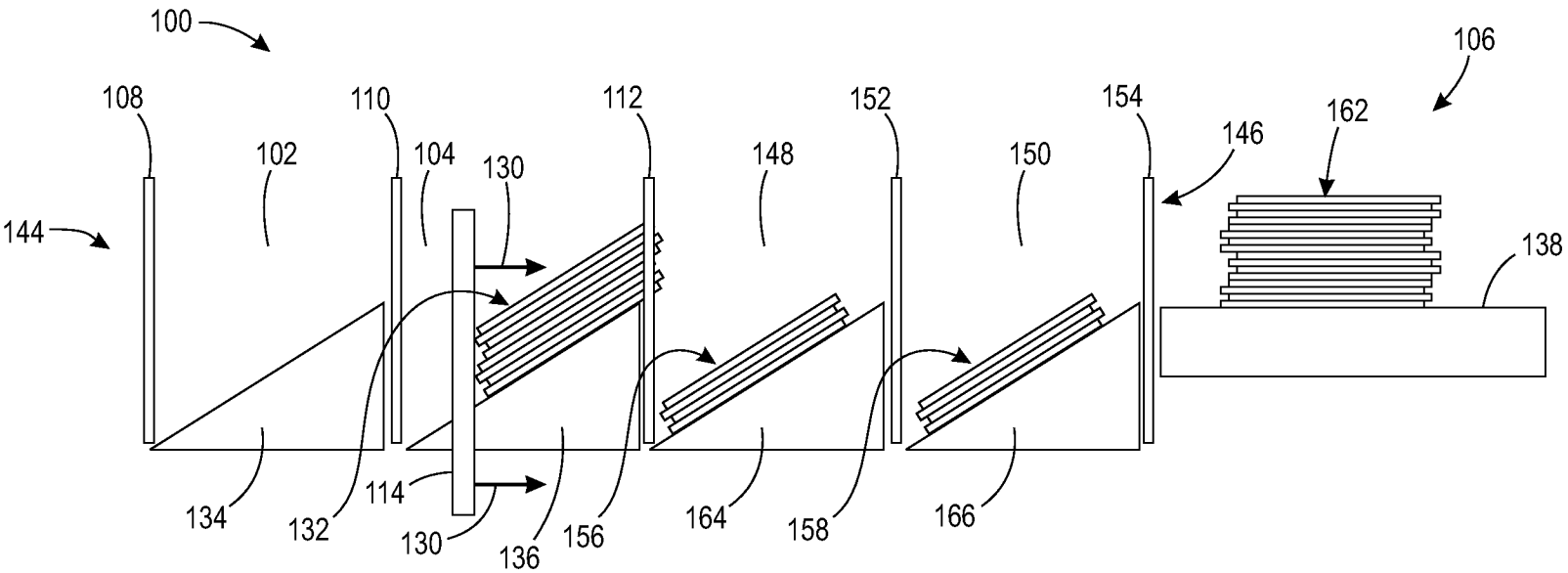
FIG. 4 is a side elevational view of the present system depicted in FIG. 3 with the plurality of guides in retracted positions and a pusher moving stacks of media toward a collated stack receiver.
Figure 5:
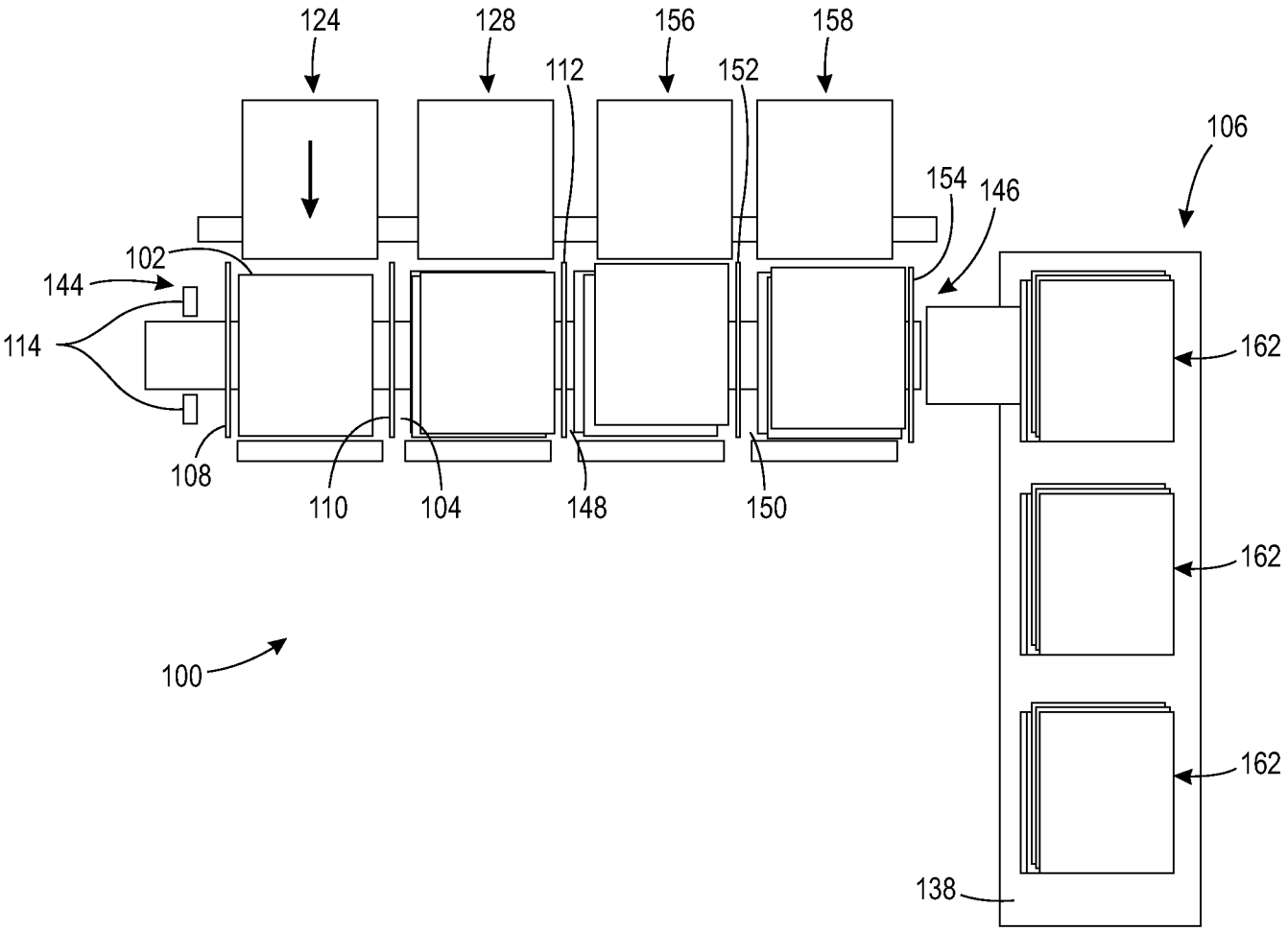
FIG. 5 is a top plan view of the present system depicted in FIG. 3.
Figure 6:
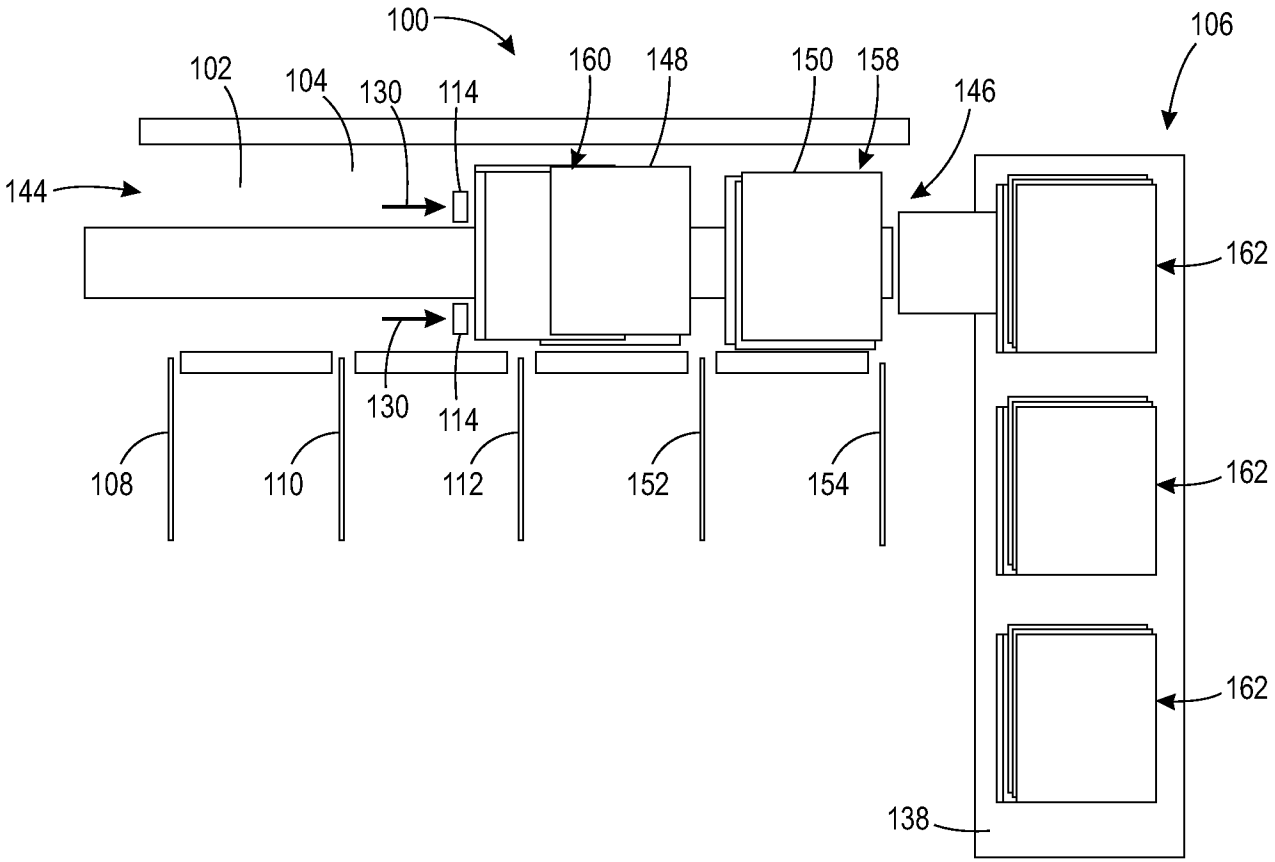
FIG. 6 is a top plan view of the present system depicted in FIG. 4.
Figure 7:
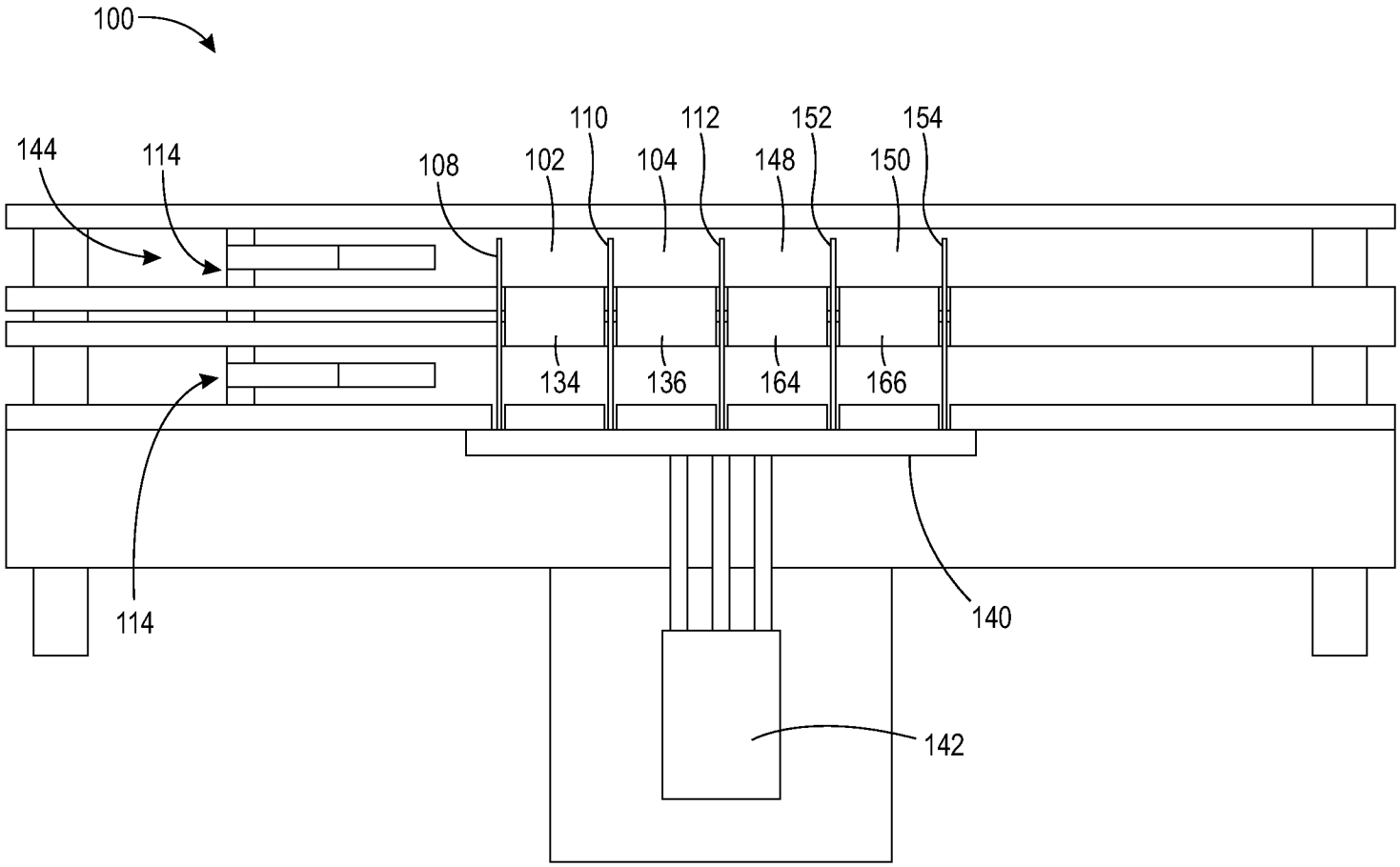
FIG. 7 is a top plan view of another embodiment of the present system for collating media with a plurality of guides in non-retracted positions collectively located by a single pneumatic actuator.
Figure 8:
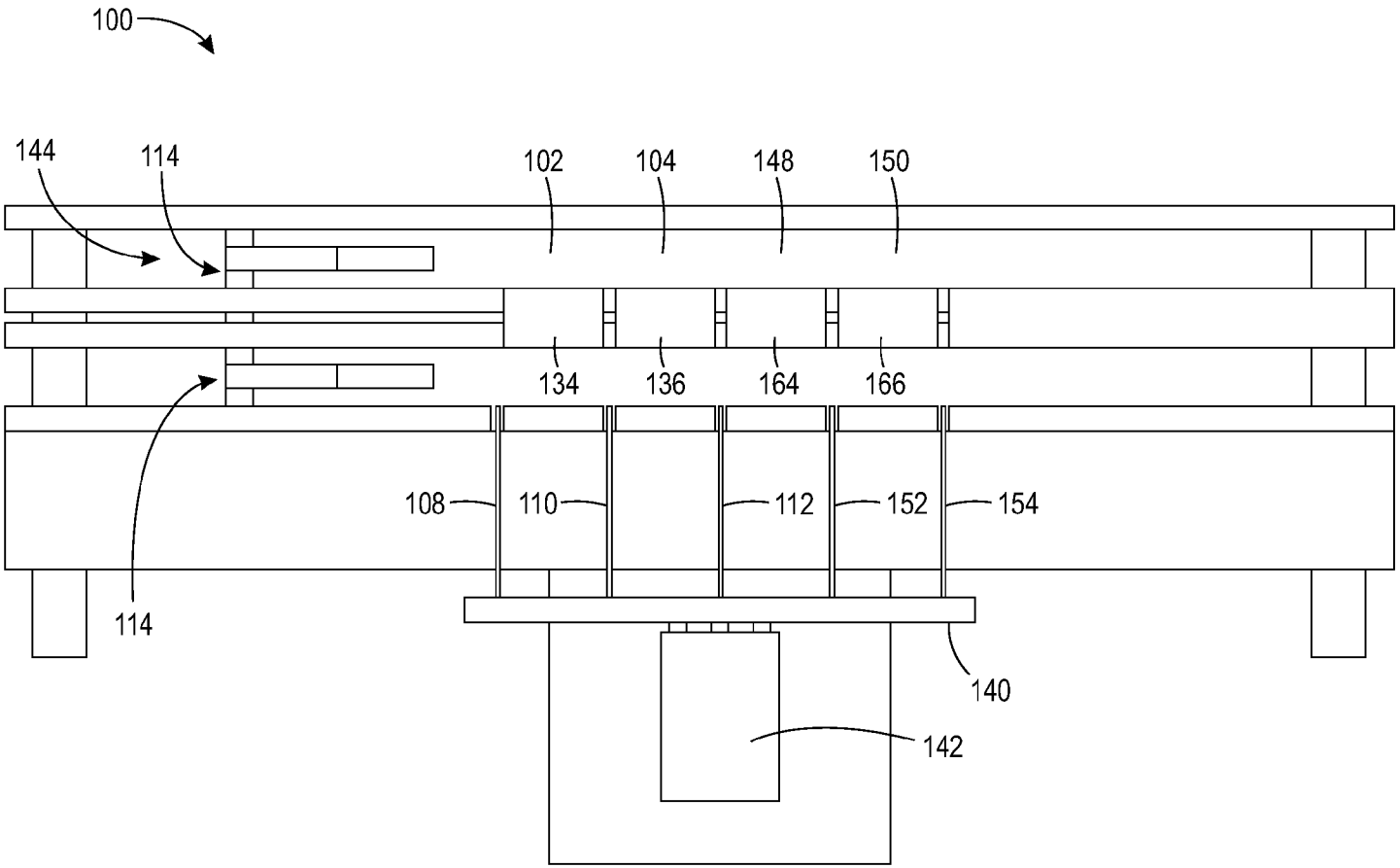
FIG. 8 is a top plan view of the present system depicted in FIG. 7 with the plurality of guides in retracted positions located simultaneously by the single pneumatic actuator; and, FIG. 9 is a top plan view of an embodiment of uncut media prior to cutting and collation by the present system.

At the outset, it should be appreciated that like drawing numbers on different drawing views identify identical, or functionally similar, structural elements of the embodiments set forth herein. Furthermore, it is understood that these embodiments are not limited to the particular methodology, materials and modifications described and as such may, of course, vary. It is also understood that the terminology used herein is for the purpose of describing particular aspects only, and is not intended to limit the scope of the disclosed embodiments, which are limited only by the appended claims.

Unless defined otherwise, all technical and scientific terms used herein have the same meaning as commonly understood to one of ordinary skill in the art to which these embodiments belong. As used herein, "average" is intended to be broadly construed to include any calculation in which a result datum or decision is obtained based on a plurality of input data, which can include but is not limited to, weighted averages, yes or no decisions based on rolling inputs, etc. Furthermore, as used herein, "average" and/or "averaging" should be construed broadly to include any algorithm or statistical process having as inputs a plurality of signal outputs, for any purpose. A "device useful for digital printing" or "digital printing" broadly encompasses creating a printed output using a processor, software and digital-based image files. It should be further understood that xerography, for example using light emitting diodes (LEDs), is a form of digital printing.

As used herein, "process direction" is intended to mean the direction of media transport through a printer or copier, while "cross process direction" is intended to mean the perpendicular to the direction of media transport through a printer or copier. With respect to the term "real time", for human interactions we mean that the time span between a triggering event and an activity in response to that event is minimized, while in a computer context we mean that data manipulation and/or compensation which occurs with little or no use of a processor, thereby resulting in efficient data manipulation and/or compensation without added processor overhead, such as delaying raw data transmission without any computational analysis of the same.

Furthermore, the words "printer," "printer system", "printing system", "printer device" and "printing device" as used herein encompasses any apparatus, such as a digital copier, bookmaking machine, facsimile machine, multi-function machine, etc. which performs a print outputting function for any purpose, while "multi-function device" and "MFD" as used herein is intended to mean a device which includes a plurality of different imaging devices, including but not limited to, a printer, a copier, a fax machine and/or a scanner, and may further provide a connection to a local area network, a wide area network, an Ethernet based network or the internet, either via a wired connection or a wireless connection. An MFD can further refer to any hardware that combines several functions in one unit. For example, MFDs may include but are not limited to a standalone printer, one or more personal computers, a standalone scanner, a mobile phone, an MP3 player, audio electronics, video electronics, GPS systems, televisions, recording and/or reproducing media or any other type of consumer or non-consumer analog and/or digital electronics. Additionally, as used herein, "sheet," "sheet of paper," "paper," and "media" refer to, for example, paper, transparencies, parchment, film, fabric, plastic, photo-finishing papers or other coated or non-coated substrate media in the form of a web upon which information or markings can be visualized and/or reproduced.

Moreover, although any methods, devices or materials similar or equivalent to those described herein can be used in the practice or testing of these embodiments, some embodiments of methods, devices, and materials are now described.

The present disclosure describes a system and method for collating a set of media. Broadly, the present system for collating a plurality of media, i.e., system 100, includes first bin 102, second bin 104 arranged adjacent to first bin 102, collated stack receiver 106 arranged proximate second bin 104 opposite first bin 102, first, second and third guides 108, 110 and 112, respectively, and pusher 114. First guide 108 and second guide 110 are positioned on opposing sides of first bin 102, i.e., sides 116 and 118, while second guide 110 and third guide 112 are positioned on opposing sides of second bin 104, i.e., sides 120 and 122. When first, second and third guides 108, 110 and 112, respectively, are positioned in non-retracted locations (See FIGS. 1, 3, 5 and 7), first set 124 of plurality of media 126 is deposited in first bin 102 and second set 128 of plurality of media 126 is deposited in second bin 104. When the first, second and third guides 108, 110 and 112, respectively, are positioned in retracted locations (See FIGS. 2, 4, 6 and 8), pusher 114, in the direction depicted by unidirectional arrows 130, moves first set 124 to second bin 104 vertically above second set 128 to form a first combined set, i.e., combined set 132, and moves combined set 132 to collated stack receiver 106. The foregoing is explained in greater detail infra.

In some embodiments, first bin 102 comprises angularly disposed shelf 134 and second bin 104 comprises angularly disposed shelf 136. In these embodiments, when first, second and third guides 108, 110 and 112, respectively, are positioned in non-retracted locations (See FIGS. 1, 3, 5 and 7), first set 124 of plurality of media 126 is deposited on angularly disposed shelf 134 and second set 126 of plurality of media 126 is deposited on angularly disposed shelf 136.

Moreover, in these embodiments, when first, second and third guides 108, 110 and 112, respectively, are positioned in retracted locations (See FIGS. 2, 4, 6 and 8), pusher 114 moves first set 124 to angularly disposed shelf 136 vertically above second set 128 to form combined set 132 and moves combined set 132 to collated stack receiver 106.

In some embodiments, collated stack receiver 106 comprises a moving surface, e.g., moving surface 138. It should be appreciated moving surface 138 may be formed by a variety of means, such as a moving belt, a moving plate, a rotating carousel, etc., and such embodiments fall within the scope of the claims below.

In some embodiments, first, second and third guides 108, 110 and 112, respectively, move between non-retracted and retracted positions simultaneously. As shown in the transition between FIGS. 7 and 8, all guides may be joined together as a single unit in which all guides move between non-retracted and retracted at the same time. For example, plate 140 joins first, second and third guides 108, 110 and 112, respectively, and actuator 142 moves plate 140 between non-retracted and retracted positions, thereby simultaneously moving all guides between non-retraced and retracted positions. In some embodiments, first, second and third guides 108, 110 and 112, respectively, move between non-retracted and retracted positions serially. In these embodiments, each guide may be separately actuatable between non-retracted and retracted positions, may mechanically interact with each other such that each guide moves in series, or any other suitable means of consecutively actuating the guides between non-refracted and retracted positions.

In some embodiments, pusher 114 moves generally horizontally from starting location 144 adjacent first bin 102 toward finishing location 146 adjacent collated stack receiver 106. In some embodiments, pusher 114 moves generally horizontally from finishing location 146 adjacent collated stack receiver 106 toward starting location 144 adjacent first bin 102. In some embodiments, pusher 114 moves generally horizontally and vertically below first bin 102 and second bin 104 from finishing location 146 adjacent collated stack receiver 106 toward starting location 144 adjacent first bin 102. In short, this embodiment permits the movement of pusher 114 to starting location 144 while a subsequent set of cards are being deposited in the bins.

In some embodiments, system 100 further comprises third bin 148 arranged adjacent to second bin 104 opposite first bin 102, fourth bin 150 arranged adjacent to third bin 148 opposite second bin 104, and fourth and fifth guides 152 and 154, respectively. Collated stack receiver 106 is arranged adjacent fourth bin 150 opposite third bin 148. Third guide 112 and fourth guide 152 are positioned on opposing sides of third bin 148, and fourth guide 152 and fifth guide 154 are positioned on opposing sides of fourth bin 104. In these embodiments, when first, second, third, fourth and fifth guides 108, 110, 112, 152 and 154, respectively, are positioned in non-retracted locations (See FIGS. 1, 3, 5 and 7), first set 124 of plurality of media 126 is deposited in first bin 102, second set 128 of plurality of media 126 is deposited in second bin 104, third set 156 of plurality of media 126 is deposited in third bin 148 and fourth set 158 of plurality of media 126 is deposited in fourth bin 150. Additionally, in these embodiments, when first, second, third, fourth and fifth guides 108, 110, 112, 152 and 154, respectively, are positioned in retracted locations (See FIGS. 2, 4, 6 and 8), pusher 114 moves first set 124 to second bin 104 vertically above second set 128 to form a first combined set, i.e., combined set 132, then moves combined set 132 to third bin 148 vertically above third set 156 to form a second combined set, i.e., combined set 160, then moves combined set 160 to fourth bin 150 vertically above fourth set 158 to form a third combined set, i.e., the combination of combined set 160 and fourth set 158, and then moves combined set 162 to collated stack receiver 106.

In some embodiments, first bin 102 comprises angularly disposed shelf 134, second bin 104 comprises angularly disposed shelf 136, third bin 148 comprises angularly disposed shelf 164 and fourth bin 150 comprises angularly disposed shelf 166. In some embodiments, when first, second, third, fourth and fifth guides 108, 110, 112, 152 and 154, respectively, are positioned in non-retracted locations (See FIGS. 1, 3, 5 and 7), first set 124 of plurality of media 126 is deposited on angularly disposed shelf 134, second set 128 of plurality of media 126 is deposited on angularly disposed shelf 136, third set 156 of plurality of media 126 is deposited on angularly disposed shelf 164 and fourth set 158 of plurality of media 126 is deposited on angularly disposed shelf 166, and when first, second, third, fourth and fifth guides 108, 110, 112, 152 and 154, respectively, are positioned in retracted locations (See FIGS. 2, 4, 6 and 8), pusher 114 moves first set 124 to angularly disposed shelf 136 vertically above second set 128 to form combined set 132, then moves combined set 132 to angularly disposed shelf 164 vertically above third set 156 to form combined set 160, then moves combined set 160 to angularly disposed shelf 166 vertically above fourth set 158 to form combined set 162 and then moves combined set 162 to collated stack receiver 106.

As described above, the present disclosure describes a method for collating a set of media. Broadly, the present method for collating a plurality of media in a system comprising a first bin, a second bin arranged adjacent to the first bin, a collated stack receiver arranged proximate the second bin opposite the first bin, first, second and third guides, the first and second guides positioned on opposing sides of the first bin, and the second and third guides positioned on opposing sides of the second bin, and a pusher. The method comprises positioning the first, second and third guides in non-retracted locations, depositing a first set of the plurality of media in the first bin and a second set of the plurality of media in the second bin, positioning the first, second and third guides in retracted locations; moving the first set with the pusher to the second bin vertically above the second set to form a first combined set; moving the first combined set with the pusher to the collated stack receiver.

In embodiments wherein the first bin comprises a first angularly disposed shelf and the second bin comprises a second angularly disposed shelf, the present method further comprises depositing the first set of the plurality of media on the first angularly disposed shelf and the second set of the plurality of media on the second angularly disposed shelf and moving the first set with the pusher to the second angularly disposed shelf vertically above the second set to form the first combined set.

In embodiments wherein the collated stack receiver comprises a moving surface, the present method further comprises moving the first combined set with the collated stack receiver.

In some embodiments, the first, second and third guides are positioned in non-retracted locations simultaneously and the first, second and third guides are positioned in retracted positions simultaneously. In some embodiments, the first, second and third guides are positioned in non-retracted locations serially and the first, second and third guides are positioned in retracted positions serially. In some embodiments, a combination of simultaneous and serial movement of the guides occurs, e.g., serial movement from non-retracted to retracted locations and simultaneous movement from retracted to non-retracted locations.

As described above, some embodiments of the present system comprise a third bin arranged adjacent to the second bin opposite the first bin, a fourth bin arranged adjacent to the third bin opposite the second bin, the collated stack receiver is arranged adjacent to the fourth bin opposite the third bin, and fourth and fifth guides, where the third and fourth guides are positioned on opposing sides of the third bin, and the fourth and fifth guides are positioned on opposing sides of the fourth bin. In such embodiments, the present method described above further comprises positioning the fourth and fifth guides in non-retracted locations, depositing a third set of the plurality of media in the third bin and a fourth set of the plurality of media in the fourth bin, positioning the fourth and fifth guides in retracted locations, moving the first combined set with the pusher to the third bin vertically above the third set to form a second combined set, and moving the second combined set with the pusher to the fourth bin vertically above the fourth set to form a third combined set, and moving the third combined set with the pusher to the collated stack receiver.

In embodiments comprising the third and fourth bins wherein the first bin comprises a first angularly disposed shelf, the second bin comprises a second angularly disposed shelf, the third bin comprises a third angularly disposed shelf and the fourth bin comprises a fourth angularly disposed shelf, the present method is further modified. For example, in such embodiments, the present method comprises depositing the first set of the plurality of media on the first angularly disposed shelf, the second set of the plurality of media on the second angularly disposed shelf, the third set of the plurality of media on the third angularly disposed shelf and the fourth set of the plurality of media on the fourth angularly disposed shelf, and moving the first set with the pusher to the second angularly disposed shelf vertically above the second set to form the first combined set, moving the first combined set with the pusher to the third angularly disposed shelf vertically above the third set to form the second combined set and moving the second combined set with the pusher to the fourth angularly disposed shelf vertically above the fourth set to form the third combined set.

Figure 9:
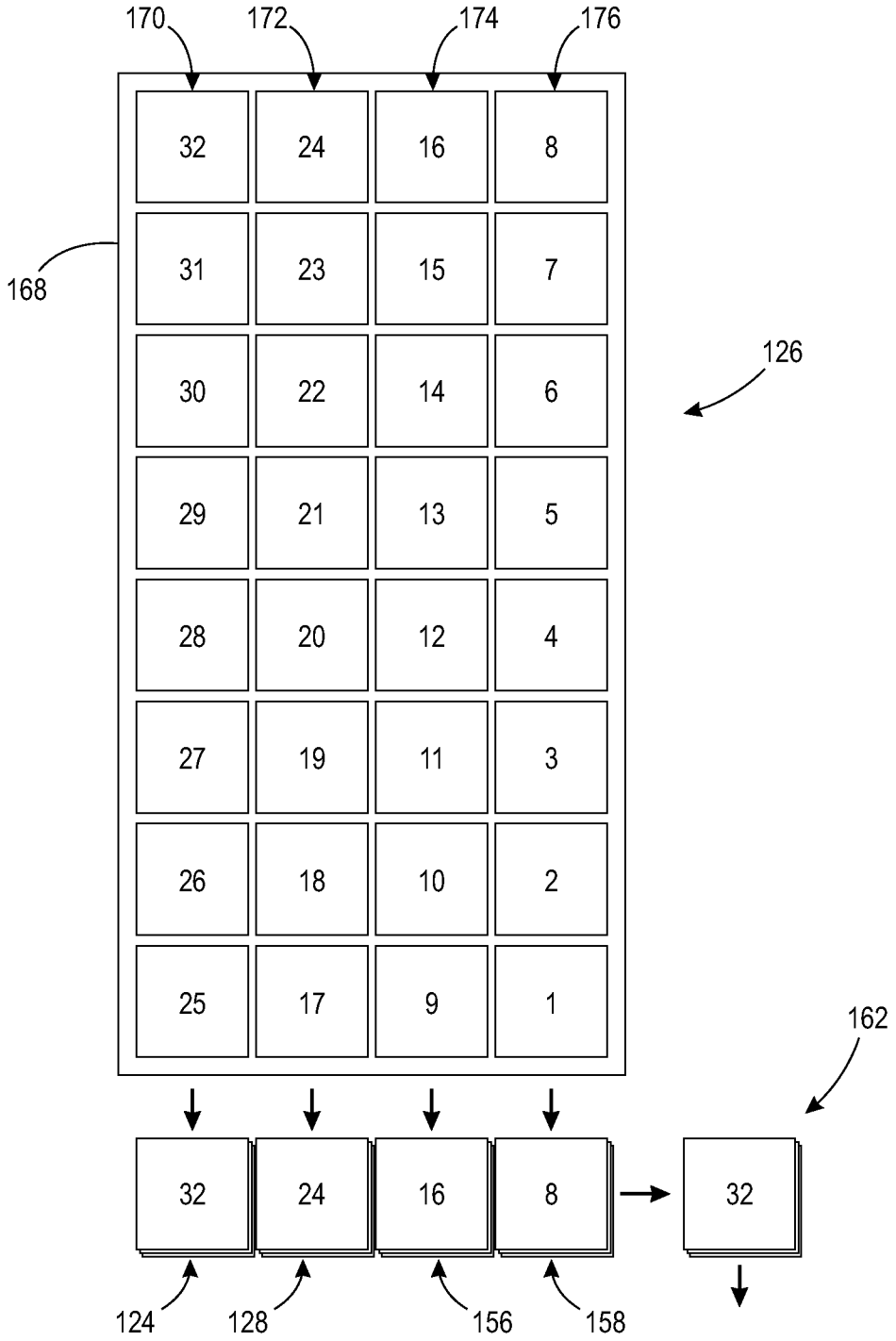

An embodiment of, plurality of media 126 is depicted in the form of sheet 168 in FIG. 9. It should be appreciated that each stack formed in each bin is the result of process and cross-process direction cutting of sheet 168 such that an entire column of cards is deposited in a particular bin, e.g., column 170 in first bin 102, column 172 in second bin 104, column 174 in third bin 148 and column 176 in fourth bin 150. The numbers shown in the individual card regions within sheet 168 represent the order of the final collated stack from bottom to top within the stack. It should be appreciated that for embodiments of the present system having greater than or less than four bins, the column arrangement of sheet 168 will be modified accordingly, e.g., two bins would require two columns.

The present automated system utilizes a right angle collating system which is used to compile the cards in bins and then sweep the cards with a pusher system. This system can produce ninety-six piece or greater card stacks automatically without operators sweeping shingled sets as required to create stacks in known systems. The present system compiles the printed cards into the angled bins consistently due to the placement of the guides. The present system prevents cards from bouncing as the cards drop and settle into each bin. It has been found that the present system can account for the variation created by an offset mass and/or release liner edges within each card, which aspects promote poor stack quality and failed compiling and collations in known collating systems.

The present system provides a four sided bin with two retractable side guides for each of the sets to be compiled. It then allows for the guides to be removed so that a pusher system can move the compiled sets in the cross process direction to create a final collation. The present system effectively creates a four sided bin for compiling sets while eliminating bin obstructions for the cross process collation of the cards. The guides are attached to a means of actuation such as a linear air actuator and the guides are then held in place and aligned with the card to card gap or gutter. Once the present system detects that the appropriate number of sheets have been processed to compile the desired cards per bin, e.g., three sheets processed to compile twenty-four cards per bin, the guides are retracted and the cross process pusher is actuated in the cross process direction to create the final card collation. The guides are then fired into place, i.e., a non-retracted position, and the pushers are lowered below the bins and returned to the start position as the next sets of cards are being compiled.

The present system and method provide a retractable guide system used for cross process collation of adhesive containing in-store signage and/or cards. The present collation system is capable of stacking sheet by sheet sequentially imposed printed or imaged cards at high speed by using the retractable guide system which keeps adjacent sets of cards from mis-registering and causing jams. The present system is capable of providing store signage in planogram order to stores with a sheet to sheet imposition that minimizes media scrap percentages and operator intervention.

The present system and method provide means to collate an entire store's production in planogram order. The present system and method deliver sets or cards in final stacks eliminating need for operators to collated shingled output into final stacks. Moreover, the present system and method allow for further downstream automation since cards are delivered to an output conveyor in final stacks rather than shingled sets.

It will be appreciated that various of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

What is claimed is:

1. A system for collating a plurality of media comprising:

a first bin;

a second bin arranged adjacent to the first bin;

a collated stack receiver arranged proximate the second bin opposite the first bin;

first, second and third guides, the first and second guides positioned on opposing sides of the first bin, and the second and third guides positioned on opposing sides of the second bin; and, a pusher, wherein when the first, second and third guides are positioned in non-retracted locations, a first set of the plurality of media is deposited in the first bin and a second set of the plurality of media is deposited in the second bin, and when the first, second and third guides are positioned in retracted locations, the pusher moves the first set to the second bin vertically above the second set to form a first combined set and moves the first combined set to the collated stack receiver.

2. The system of claim 1 wherein the first bin comprises a first angularly disposed shelf and the second bin comprises a second angularly disposed shelf.

3. The system of claim 2 wherein when the first, second and third guides are positioned in non-retracted locations, the first set of the plurality of media is deposited on the first angularly disposed shelf and the second set of the plurality of media is deposited on the second angularly disposed shelf, and when the first, second and third guides are positioned in retracted locations, the pusher moves the first set to the second angularly disposed shelf vertically above the second set to form the first combined set and moves the first combined set to the collated stack receiver.

4. The system of claim 1 wherein the collated stack receiver comprises a moving surface.

5. The system of claim 1 wherein the first, second and third guides move between non-retracted and retracted positions simultaneously.

6. The system of claim 1 wherein the first, second and third guides move between non-retracted and retracted positions serially.

7. The system of claim 1 wherein the pusher moves generally horizontally from a starting location adjacent the first bin toward a finishing location adjacent the collated stack receiver.

8. The system of claim 1 wherein the pusher moves generally horizontally and vertically below the first and second bins from a finishing location adjacent the collated stack receiver toward a starting location adjacent the first bin.

9. The system of claim 1 further comprising:

a third bin arranged adjacent to the second bin opposite the first bin;

a fourth bin arranged adjacent to the third bin opposite the second bin;

the collated stack receiver arranged adjacent the fourth bin opposite the third bin; and, fourth and fifth guides, the third and fourth guides positioned on opposing sides of the third bin, and the fourth and fifth guides positioned on opposing sides of the fourth bin, wherein when the first, second, third, fourth and fifth guides are positioned in non-retracted locations, a first set of the plurality of media is deposited in the first bin, a second set of the plurality of media is deposited in the second bin, a third set of the plurality of media is deposited in the third bin and a fourth set of the plurality of media is deposited in the fourth bin, and when the first, second, third, fourth and fifth guides are positioned in retracted locations, the pusher moves the first set to the second bin vertically above the second set to form a first combined set, moves the first combined set to the third bin vertically above the third set to form a second combined set, moves the second combined set to the fourth bin vertically above the fourth set to form a third combined set and moves the third combined set to the collated stack receiver.

10. The system of claim 9 wherein the first bin comprises a first angularly disposed shelf, the second bin comprises a second angularly disposed shelf, the third bin comprises a third angularly disposed shelf and the fourth bin comprises a fourth angularly disposed shelf.

11. The system of claim 10 wherein when the first, second, third, fourth and fifth guides are positioned in non-retracted locations, the first set of the plurality of media is deposited on the first angularly disposed shelf, the second set of the plurality of media is deposited on the second angularly disposed shelf, the third set of the plurality of media is deposited on the third angularly disposed shelf and the fourth set of the plurality of media is deposited on the fourth angularly disposed shelf, and when the first, second, third, fourth and fifth guides are positioned in retracted locations, the pusher moves the first set to the second angularly disposed shelf vertically above the second set to form the first combined set, moves the first combined set to the second angularly disposed shelf vertically above the second set to form a second combined set, moves the second combined set to the third angularly disposed shelf vertically above the second combined set to form a third combined set and moves the third combined set to the collated stack receiver.

12. A method for collating a plurality of media in a system comprising a first bin, a second bin arranged adjacent to the first bin, a collated stack receiver arranged proximate the second bin opposite the first bin, first, second and third guides, the first and second guides positioned on opposing sides of the first bin, and the second and third guides positioned on opposing sides of the second bin, and a pusher, the method comprising:

a) positioning the first, second and third guides in non-retracted locations;

b) depositing a first set of the plurality of media in the first bin and a second set of the plurality of media in the second bin;

c) positioning the first, second and third guides in retracted locations;

d) moving the first set with the pusher to the second bin vertically above the second set to form a first combined set; and, e) moving the first combined set with the pusher to the collated stack receiver.

13. The method of claim 12 wherein the first bin comprises a first angularly disposed shelf and the second bin comprises a second angularly disposed shelf.

14. The method of claim 13 wherein step b) comprises: depositing the first set of the plurality of media on the first angularly disposed shelf and the second set of the plurality of media on the second angularly disposed shelf and step d) comprises: moving the first set with the pusher to the second angularly disposed shelf vertically above the second set to form the first combined set.

15. The method of claim 12 wherein the collated stack receiver comprises a moving surface , the method further comprising:

f) moving the first combined set with the collated stack receiver.

16. The method of claim 12 wherein the first, second and third guides are positioned in non-retracted locations simultaneously and the first, second and third guides are positioned in retracted positions simultaneously.

17. The method of claim 12 wherein the first, second and third guides are positioned in non-retracted locations serially and the first, second and third guides are positioned in retracted positions serially.

18. The method of claim 12 wherein during steps d) and e) the pusher moves generally horizontally from a starting location adjacent the first bin toward a finishing location adjacent the collated stack receiver.

19. The method of claim 12 further comprising:

f) moving the pusher generally horizontally and vertically below the first and second bins from a finishing location adjacent the collated stack receiver toward a starting location adjacent the first bin.

20. The method of claim 12 wherein the system further comprises a third bin arranged adjacent to the second bin opposite the first bin, a fourth bin arranged adjacent to the third bin opposite the second bin, the collated stack receiver arranged adjacent to the fourth bin opposite the third bin, and fourth and fifth guides, the third and fourth guides positioned on opposing sides of the third bin, and the fourth and fifth guides positioned on opposing sides of the fourth bin, and wherein:

step a) further comprises: positioning the fourth and fifth guides in non-retracted locations;

step b) further comprises: depositing a third set of the plurality of media in the third bin and a fourth set of the plurality of media in the fourth bin;

step c) further comprises: positioning the fourth and fifth guides in retracted locations;

step d) further comprises: moving the first combined set with the pusher to the third bin vertically above the third set to form a second combined set, and moving the second combined set with the pusher to the fourth bin vertically above the fourth set to form a third combined set; and, step e) comprises: e) moving the third combined set with the pusher to the collated stack receiver.

21. The method of claim 20 wherein the first bin comprises a first angularly disposed shelf, the second bin comprises a second angularly disposed shelf, the third bin comprises a third angularly disposed shelf and the fourth bin comprises a fourth angularly disposed shelf.

22. The method of claim 21 wherein step b) comprises: depositing the first set of the plurality of media on the first angularly disposed shelf, the second set of the plurality of media on the second angularly disposed shelf, the third set of the plurality of media on the third angularly disposed shelf and the fourth set of the plurality of media on the fourth angularly disposed shelf; and step d) comprises: moving the first set with the pusher to the second angularly disposed shelf vertically above the second set to form the first combined set, moving the first combined set with the pusher to the third angularly disposed shelf vertically above the third set to form the second combined set and moving the second combined set with the pusher to the fourth angularly disposed shelf vertically above the fourth set to form the third combined set.

* * * * *